US011008891B2

(12) United States Patent
Kraemer et al.

(10) Patent No.: US 11,008,891 B2
(45) Date of Patent: May 18, 2021

(54) ASSEMBLED TURBINE HOUSING

(71) Applicant: Ford Global Technologies, LLC, Dearborn, MI (US)

(72) Inventors: Frank Kraemer, Neunkirchen-Seelscheid (DE); Kai Sebastian Kuhlbach, Bergisch Gladbach (DE); Ludwig Stump, Cologne (DE); Jan Mehring, Cologne (DE); Stefan Quiring, Leverkusen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 365 days.

(21) Appl. No.: 15/595,801

(22) Filed: May 15, 2017

(65) Prior Publication Data

US 2017/0350277 A1 Dec. 7, 2017

(30) Foreign Application Priority Data

Jun. 7, 2016 (DE) ..... 102016209951.5

(51) Int. Cl.
*F01D 25/24* (2006.01)
*F01D 5/04* (2006.01)
(Continued)

(52) U.S. Cl.
CPC ..... *F01D 25/24* (2013.01); *F01D 5/043* (2013.01); *F01D 9/023* (2013.01); *F01D 9/06* (2013.01); *F01D 25/005* (2013.01); *F05D 2220/40* (2013.01); *F05D 2230/232* (2013.01); *F05D 2300/111* (2013.01); *F05D 2300/121* (2013.01); *F05D 2300/171* (2013.01)

(58) Field of Classification Search
CPC ..... F01D 25/24; F01D 25/26; F01D 25/265; F01D 9/026; F01D 25/005; F05D 2230/90; F05D 2260/95; F05D 2220/40; F05D 2230/232; F05D 2300/111; F05D 2300/121; F05D 2300/171
See application file for complete search history.

(56) References Cited

U.S. PATENT DOCUMENTS 4,300,349 A 11/1981 Heckel
4,490,622 A * 12/1984 Osborn ..... F01D 25/16 290/2

(Continued)

FOREIGN PATENT DOCUMENTS

CN 2835566 Y 11/2006
DE 3025137 A1 1/1981

(Continued)

OTHER PUBLICATIONS

Mixing Welds and Bolts, Miller, Duane K., Jun. 13, 2002 (Year: 2002).*

*Primary Examiner* — Aaron R Eastman
(74) *Attorney, Agent, or Firm* — Geoffrey Brumbaugh; McCoy Russell LLP

(57) ABSTRACT

An exhaust gas turbine is provided. The exhaust gas turbine includes a first turbine housing part having insulating material extending along an interior surface and a second turbine housing part having insulating material extending along an interior surface, the second turbine housing part coupled to the first turbine housing part to form a volute directing exhaust gas to a turbine wheel.

18 Claims, 4 Drawing Sheets

(51) Int. Cl.

| | |
|---|---|
| ***F01D 9/02*** | (2006.01) |
| ***F01D 9/06*** | (2006.01) |
| ***F01D 25/00*** | (2006.01) |

(56) References Cited

U.S. PATENT DOCUMENTS

| | | | | |
|---|---|---|---|---|
| 4,735,556 | A * | 4/1988 | Fujikake | F01D 25/145 165/904 |
| 5,185,217 | A * | 2/1993 | Miyamoto | F01D 11/122 277/411 |
| 7,074,009 | B2 | 7/2006 | Allmang et al. | |
| 7,568,338 | B2 * | 8/2009 | Noelle | F01D 9/042 415/199.1 |
| 8,062,006 | B2 * | 11/2011 | Hummel | F01D 25/24 415/203 |
| 9,097,121 | B2 | 8/2015 | Joergl et al. | |
| 9,581,045 | B2 * | 2/2017 | Nagae | F01D 25/24 |
| 9,737,964 | B2 * | 8/2017 | Sordelet | B23P 6/00 |
| 9,784,127 | B2 * | 10/2017 | Kuhlbach | F01D 25/145 |

FOREIGN PATENT DOCUMENTS

| | | | | |
|---|---|---|---|---|
| DE | 10022052 | A1 | 3/2001 | |
| DE | 2005018420 | U1 | 3/2006 | |
| EP | 1790832 | A1 | 5/2007 | |
| GB | 2054055 | A | 2/1981 | |
| WO | WO-2005108747 | A1 * | 11/2005 | C23C 4/02 |
| WO | 2010039590 | A2 | 4/2010 | |
| WO | WO-2014176027 | A1 * | 10/2014 | F01D 9/026 |
| WO | 2016010847 | A1 | 1/2016 | |

* cited by examiner

ASSEMBLED TURBINE HOUSING

CROSS REFERENCE TO RELATED APPLICATION

The present application claims priority to German Patent Application No. 102016209951.5, filed on Jun. 7, 2016. The entire contents of the above-referenced application are hereby incorporated by reference in its entirety for all purposes.

BACKGROUND/SUMMARY

The combustion gases of an internal combustion engine naturally have a high level of thermal energy. The exhaust gas flow which is created as a result of the thermal energy of the combustion gases is greatest directly downstream of the cylinder heads or the engine manifold. Located at this point is the turbocharger, the function of which is to convert some of the thermal energy and therefore to re-utilize it for the combustion process. The turbocharger comprises on the one hand a compressor and on the other hand a turbine that are intercoupled via a shaft. The compressor compresses the intake air for the combustion process and therefore supplies the energy which is converted by the turbocharger to the combustion process.

The turbine comprises a turbine wheel having a housing which encloses the turbine wheel in a spiral profile, a flow inlet duct and a flow outlet duct. The path of the exhaust gas flow of the combustion gases of an internal combustion engine extends through the flow inlet passage, through the turbine wheel and continues through the flow outlet duct. On account of the close position of the turbocharger to the cylinder heads or to the engine manifold, the temperature of the exhaust gas flow is very high. The inner walls of the turbine housing are very heavily exposed to the thermal stresses which are caused by the exhaust gas flow. Furthermore, the high temperatures on the walls of turbine housing lead to thermal bridges which could compromise, damage, or even destroy the elements outside of the turbine housing. It is therefore an aim of the engine manufacturer to reduce the thermal bridges of the turbine housing of a turbocharger. In the prior art, different approaches are disclosed.

Disclosed in U.S. Pat. No. 9,097,121 B2 is an insulation for a turbocharger which on the one hand protects the inner walls of the flow inlet duct and on the other hand protects the inner walls of the flow outlet duct against the hot exhaust gas flow of the internal combustion engine. The insulation consists of two sleeves. The first sleeve is introduced into the flow inlet duct and the second sleeve is introduced into the flow outlet duct. Both sleeves in this case protect only the inner walls of the flow inlet duct and of the flow outlet duct against the high temperatures of the exhaust gas flow. The flow inlet duct and the flow outlet duct are typically not directly interconnected. Therefore, the two sleeves do not cover any of the fully closed regions inside the turbine housing. The region between the two sleeves is not separately protected against the high temperatures of the exhaust gas flow. In particular, the turbine wheel housing which encloses the turbine wheel in a spiral profile is exposed to the high temperatures of the exhaust gas flow of the internal combustion engine. Furthermore, the introduction of the sleeves takes place after production of the turbine housing. In this case, the sleeves are not connected in a positive-locking manner to the individual ducts.

Further documents of the prior art refer to just the outer insulation of a turbine housing. The outer insulation of a turbine housing of a turbocharger aims above all at heat insulation of the turbine housing itself. The quantity of heat which is emitted to the turbine housing by the exhaust gas flow can compromise, damage or even destroy elements in the surrounding region of the turbocharger. An outer insulation is in this case helpful and reduces the outwardly emitting quantity of heat. With this type of insulation, however, the inner walls of the individual ducts, especially of the flow inlet duct, of the flow outlet duct and the inner region of the turbine wheel housing which encloses the turbine wheel in a spiral-like manner are not protected against the high temperatures of the exhaust gas flow. Examples of an outer insulation of a turbine housing are to be gathered from documents U.S. Pat. No. 7,074,009 B2, DE 100 22 052 A1, U.S. Pat. No. 4,300,349 A, WO 2016/010847 A1 and CN 2835566Y.

Turbine housings of a turbocharger are for the most part stamped out in one piece. U.S. Pat. No. 7,074,009 B2 and DE 100 22 052 A1 in each case disclose a turbine housing which consists of a plurality of layers. In U.S. Pat. No. 7,074,009 B2, the turbine housing is first of all assembled and in the second step the insulating lining is applied from the outside. The insulating lining is in this case fitted to the turbine housing is a positive-locking manner. In DE 100 22 052 A1, the turbine housing is assembled from a plurality of metal sheets. The individual metal sheets in this case can be coated with heat insulating effect.

The inventors have recognized the aforementioned drawbacks and facing these challenges developed an exhaust gas turbine. The exhaust gas turbine includes a first turbine housing part having insulating material extending along an interior surface and a second turbine housing part having insulating material extending along an interior surface, the second turbine housing part coupled to the first turbine housing part to form a volute directing exhaust gas to a turbine wheel. An exhaust gas turbine designed with a two part housing enables insulating material to be efficiently applied to internal surfaces of the housing to improve the thermal properties of the turbine.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

Further features, characteristics and advantages of the present invention are gathered from the following description of exemplary embodiments with reference to the attached figures.

At least FIGS. 1-4 are drawn to scale. However, other relative dimensions may be used in other embodiments.

DETAILED SPECIFICATION

Figure 1:
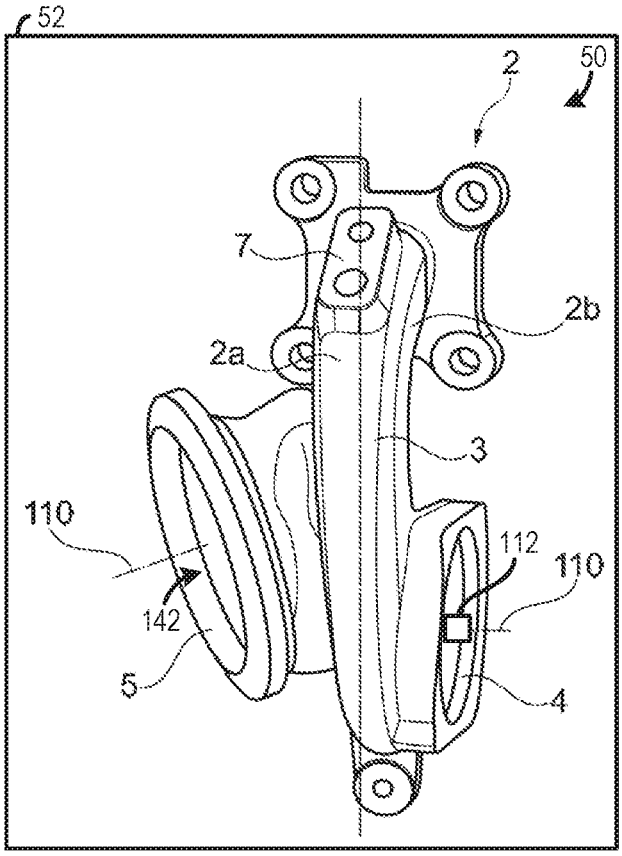
FIG. 1 shows an exemplary embodiment for a turbine housing with a surface which intersects the exhaust gas flow path parallel to the flow direction of the exhaust gas. In this view, the turbine housing is closed.

The present description relates to a turbine housing for a turbocharger and to a method for its production. In one example, an advantageous turbine housing is provided, made from cast metal, for a turbocharger. In another example, a method for producing a turbine housing is provided.

The turbine housing, made from cast metal, for a turbocharger, may be provided with an insulating material for protection against high temperatures of an exhaust gas flow. The turbine housing may include a flow inlet duct, a turbine wheel housing which encloses a turbine wheel and may be connected to the flow inlet duct, and a flow outlet duct which may be connected to the turbine wheel housing. With this, an exhaust gas flow path extends through the flow inlet duct, through the turbine wheel housing and through the flow outlet duct. In this case, the exhaust gas flow path may have a wall which is adjacent to the exhaust gas flow. The turbine housing may include at least two interconnected housing parts. A region of the exhaust gas flow path may be formed in each housing part. In this case, each exhaust gas flow path region may include a section of the wall which is adjacent to the exhaust gas flow. The insulating material may be provided along the exhaust gas flow path (e.g., entire exhaust gas flow path) on the side of the wall which faces the exhaust gas flow. The at least two housing parts may be interconnected along a surface which intersects the exhaust gas flow path perpendicularly to the flow direction of the exhaust gas. Additionally or alternatively, the at least two housing parts may be interconnected along a surface which is parallel to the flow direction of the exhaust gas in the exhaust gas path. A curved progression of the intersecting surface is also possible in this case.

Due to the fact that the turbine housing may include at least two interconnected housing parts, wherein an exhaust gas flow path region is formed in each housing part, wherein each exhaust gas flow path region may include a section of the wall which is adjacent to the exhaust gas flow, the regions (e.g., all of the regions) of the wall in the exhaust gas flow path can be made easily accessible for introducing the insulating material so that attaching the insulating material along the entire flow path becomes possible, if desired. The advantage of a turbine housing which includes at least two parts therefore lies in the fact that an insulating material can be applied to all the inner walls of the turbine housing. In this case, the regions of the inner walls which are exposed to the high temperatures of the exhaust gas flow may be of importance.

According to one example, the turbine wheel housing may enclose the turbine wheel in a spiral profile. The spiral-like stamping of the turbine wheel housing which encloses the turbine wheel leads to a channeling of the exhaust gas flow and therefore to a higher effectiveness of the energy conversion or to a higher level of efficiency.

According to another example, the exhaust gas flow path may have at least one branch. In particular, it may have a branch in the flow inlet duct and a branch in the flow outlet duct, wherein the branch in the flow inlet duct is fluidly connected to the branch in the flow outlet duct, bypassing the turbine wheel housing. The fluidic connection between the flow inlet duct and the flow outlet duct, bypassing the turbine wheel housing, may be designed as a waste-gate passage. This connection may also be referred to as a bypass.

According to another example, the turbine housing may include cast steel, cast aluminum, or gray cast iron. For instance, the turbine housing may be produced or constructed from cast steel, cast aluminum, and/or gray cast iron. Specifically in one example, the turbine housing may be produced from gray cast iron. For the reduction of weight of a turbocharger, the turbine housing may be produced from cast aluminum, in another example. In another example, a turbocharger may be used in conjunction with a high performance engine, for instance, the turbine housing may be produced from cast steel.

According to another example, the at least two housing parts may be interconnected in a positively locking, frictionally locking, or materially bonding manner. The positively locking connection can for example be produced by means of connecting flanges and at least one clamping ring. Frictionally locking or materially bonding connections may be preferred, in one example. In the case of the frictionally locking connection, screw fastening and/or riveting may be used, and in the case of the materially bonding connection welding may be used.

The turbine housing discussed herein may be produced by means of a method. For this, a method which interconnects the at least two housing parts of the turbine housing is provided. The section of the wall which is adjacent to the exhaust gas flow and located in the exhaust gas flow path region of the respective housing part may be provided, before the connection, with an insulating material for protection against high temperatures of the exhaust gas flow. For example, the wall which is adjacent to the exhaust gas flow may be provided with the insulating material by means of coating. However, inserting pre-manufactured insulating elements is also possible, in some examples.

According to one example, the housing parts may be interconnected in a positively locking, frictionally locking, or materially bonding manner. The housing parts of the turbine housing may be interconnected in a frictionally locking manner by means of screwing fastening or riveting or in a materially bonding manner by means of welding.

Described below, with reference to the figures, are exemplary embodiments for a turbine housing with an insulating lining for protection of the inner walls against high temperatures of the exhaust gas flow of an internal combustion engine.

Figure 2:
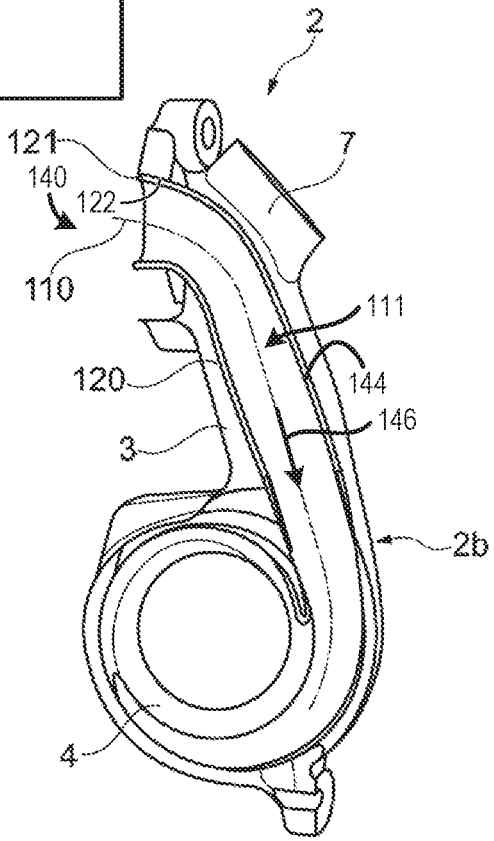
FIG. 2 shows a plan view of the connecting surface of one of the housing parts of the exemplary embodiment from FIG. 1 through the flow inlet duct.

FIGS. 1 and 2 show as a first exemplary embodiment a turbine housing 2 in an exhaust gas turbine 50, made from cast steel, for a turbocharger, with insulating material 121 forming an insulating lining. The insulating material 121 is configured to reduce the amount of heat transferred from the exhaust gas to the turbine housing. In one example, the insulating material 121 may be provided as an insulating coating. Additionally, the turbine housing 2 is included in an internal combustion engine 52 in the illustrated embodiment shown in FIG. 1.

In another example, the turbine housing 2 may be produced from aluminum or from gray cast iron. The turbine housing 2, which in the present exemplary embodiment is designed as a two-part turbine housing 2 with two housing parts 2*a*, 2*b*, includes a flow inlet duct 3, a turbine wheel housing 4 and a flow outlet duct 5. The flow inlet duct 3 may be a volute providing exhaust gas flow to a turbine wheel 112 configured to convert the exhaust gas flow into rotational energy. The turbine wheel 112 is schematically depicted in FIG. 1. Although the turbine wheel 112 is schematically depicted it will be appreciated that turbine wheel 112 has greater structural complexity. The flow inlet duct 3 includes an inlet opening 140, shown in FIG. 2, which may receive exhaust gas from an exhaust manifold or exhaust conduit in fluidic communication with an engine cylinder, in one example. The flow outlet duct 5 includes an outlet opening 142, shown in FIG. 1, which may deliver exhaust gas to downstream components such as an exhaust conduit, emission control device, etc.

An exhaust gas flow path 110 extends from the flow inlet duct 3 along the turbine wheel housing 4 up to the flow outlet duct 5. The division of the two-part turbine housing 2 is carried out along the flow inlet duct 3 and therefore parallel to a flow direction 146 of the exhaust gas, in the depicted embodiment. Specifically, FIG. 2 shows the turbine housing 2 divided along a surface 144 that is parallel to a flow direction 146. Thus, the surface 144 extends through the flow inlet duct 3 and the turbine housing 4, in the illustrated example. When the turbine housing is split in this way it may allow the insulating material to be more efficiently applied to the interior surface of the turbine housing 2, thereby reducing manufacturing costs of the turbine. Additionally, the section of the turbine housing 4 through which the surface 144 extends may surround the turbine wheel. Splitting the turbine housing in this way enables insulating material to coat surfaces of the housing around the turbine wheel, providing additional improvements in turbine thermal insulation, if desired. However, other contours of the two-part segmentation of the turbine housing have been contemplated. For instance, the surface dividing the turbine housing into the two parts may be arranged on a plane that intersects the flow direction of the exhaust gas. The plane may intersect the flow direction at an angle between 1 and 90 degrees, in one example.

Shown in FIG. 2 is a plan view of the connecting surface of the housing part 2*b* through the flow inlet duct 3. It is apparent that on account of the selected position of the connecting surface in the housing part 2*b* that the housing 2 includes a region 111 of the exhaust gas flow path 110 which, with the housing 2 assembled, forms together with the exhaust gas flow path region which is located in the other housing part 2*a*, shown in FIG. 1, the exhaust gas flow path 110. The exhaust gas flow path region 111 includes walls 120 which are adjacent to the exhaust gas flow and are easily accessible on account of the position of the connecting surface in the housing part 2*b*. The walls 120 of the exhaust gas flow path region 111 are provided, for example coated, with an insulating material 121. The applied insulating material 121 on the surface 122 (e.g., interior surface) of the inner walls 120 of the turbine housing 2 serves for protection against high temperatures of an exhaust gas flow of an internal combustion engine. Since in the other housing part 2*a* the exhaust gas flow path region which is included therein can also easily be provided with the insulating material, the effect can be achieved, with the housing 2 assembled, of the exhaust gas flow-facing side of the wall 120 which is adjacent to the exhaust gas flow being provided in total with the insulating material, in one example. Thus, in one example, the insulating material 121 may extend along the surface 122 from the inlet opening 140 to the outlet opening 142, shown in FIG. 1, in both the housing parts 2*a* and 2*b*. In other examples, the insulating material 121 may extend along the surface 122 from the inlet opening 140 to the turbine wheel housing 4 in both the housing parts 2*a* and 2*b*. However, other profiles of the insulating material have been contemplated.

Figure 3:
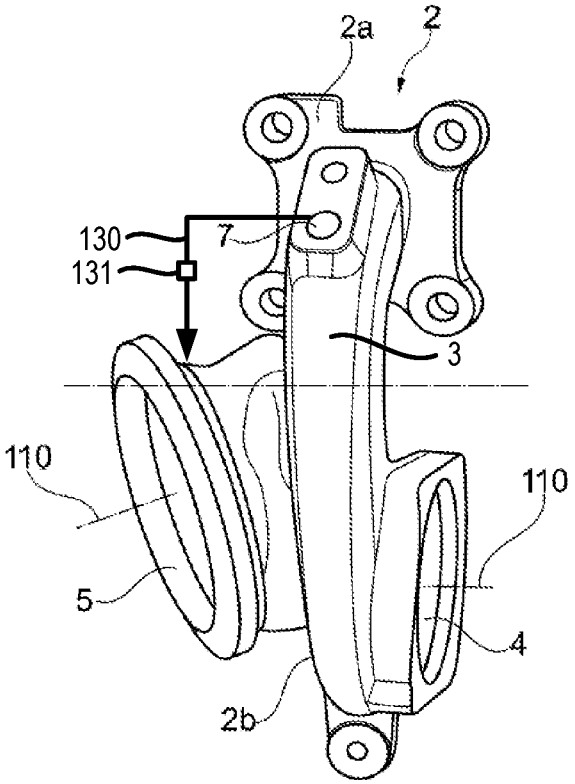
FIG. 3 shows an exemplary embodiment for a turbine housing with a surface which intersects the exhaust gas flow path perpendicularly to the flow direction of the exhaust gas. In this view, the turbine housing is closed.
Figure 4:
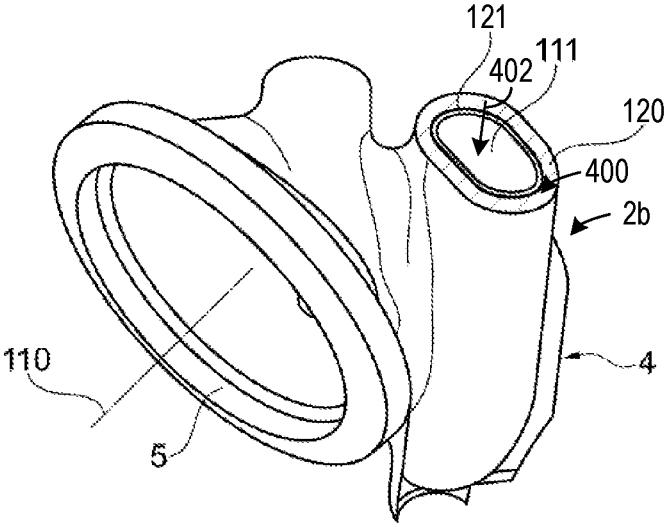
FIG. 4 shows a perspective view of the connecting surface of one of the housing parts of the exemplary embodiment from FIG. 3 through the flow inlet duct.

Shown in FIGS. 3 and 4 is a second exemplary embodiment of a turbine housing 2 made from cast steel. As in the first exemplary embodiment, the turbine housing 2 can alternatively be produced from aluminum or from gray cast iron. The arrangement of the individual components in this second exemplary embodiment is the same as in the first exemplary embodiment. The division of the turbine housing 2 into two parts 2*a*, 2*b* is carried out in the second exemplary embodiment via a parting plane which extends parallel to the cross section of the flow inlet duct 3 and therefore perpendicularly to the flow direction of the exhaust gas.

FIG. 3 also shows a branch 130 connecting the waste-gate passage 7 to the flow outlet duct 5. In this way, a bypass connecting the flow inlet duct 3 to the flow outlet duct 5 can be provided around the turbine wheel. A waste-gate valve 131 attached to the branch 130 is also shown in FIG. 3. The waste-gate valve 131 may be configured to regulate the exhaust gas flow through the branch 130. It will be appreciated that the branch 130 and waste-gate valve 131 may also be included in the embodiment of the turbine housing shown in FIGS. 1 and 2, in some examples.

FIG. 4 shows a perspective view of the connecting surface 400 of one of the housing parts 2*a*, 2*b*, shown in FIG. 3, through the flow inlet duct 3. As in the first exemplary embodiment, it is also apparent here that on account of the selected position of the connecting surface in the housing part 2*b* this includes a region 111 of the exhaust gas flow path 110. As in the first exemplary embodiment, the position of the connecting surface in the second exemplary embodiment leads to walls 120 of the exhaust gas flow path region 111 which are adjacent to the exhaust gas flow being easily accessible. The walls 120 of this exhaust gas flow path region 111 are provided, for example coated, with an insulating material 121 for protection against high temperatures of an exhaust gas flow. Since in the other housing part 2*a* the exhaust gas flow path region which is included therein can also be easily provided with the insulating material, the effect can be achieved, as in the first exemplary embodiment, with the housing 2 assembled, of the exhaust gas flow-facing side of the wall 120 which is adjacent to the exhaust gas flow being provided in total with the insulating material, if desired.

FIG. 4 shows the connecting surface 400 being arranged perpendicular to a flow direction 402 of the exhaust gas in the flow path region 111. However, other angular arrangements of the connecting surface 400 and the flow direction 402 may be used in other embodiments.

Figure 5:
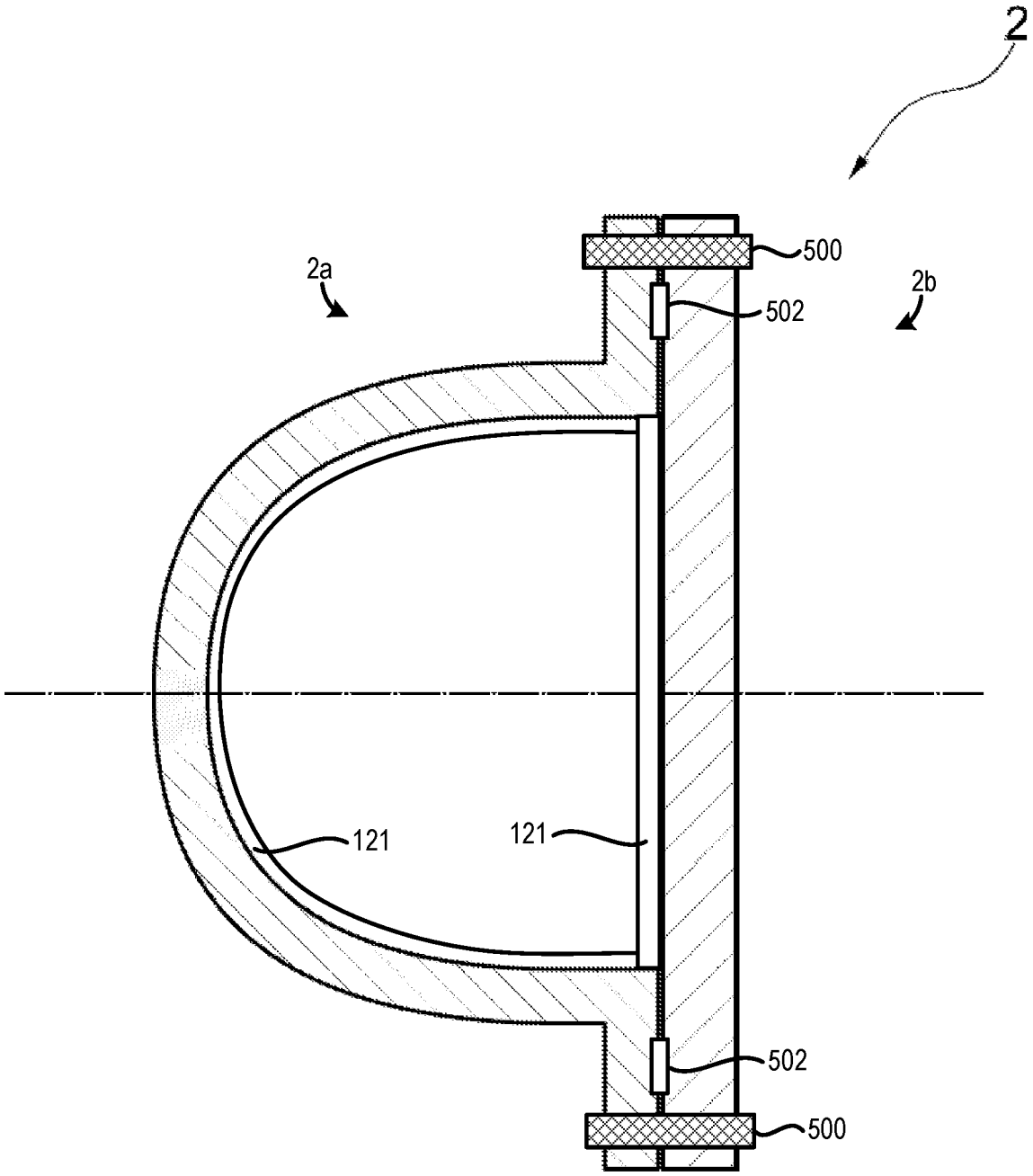
FIG. 5 shows a cross section through a multipart, screwed turbine housing.

Shown in FIG. 5 is a schematic view of a mechanical connection of the turbine housing 2 in cross section. The cross section shown in FIG. 5 may be taken along a section of the flow inlet duct 3, in one example. FIG. 5 also shows the two housing parts 2*a*, 2*b* each having insulating material 121 forming an insulating lining. FIG. 5 shows the two housing parts connected by fastening devices 500 (e.g., screw, bolt, etc.,) and welds 502. However, in other example, the two housing parts 2*a*, 2*b* may be connected by fastening devices, welds, and/or other suitable attachment techniques.

Figure 6:
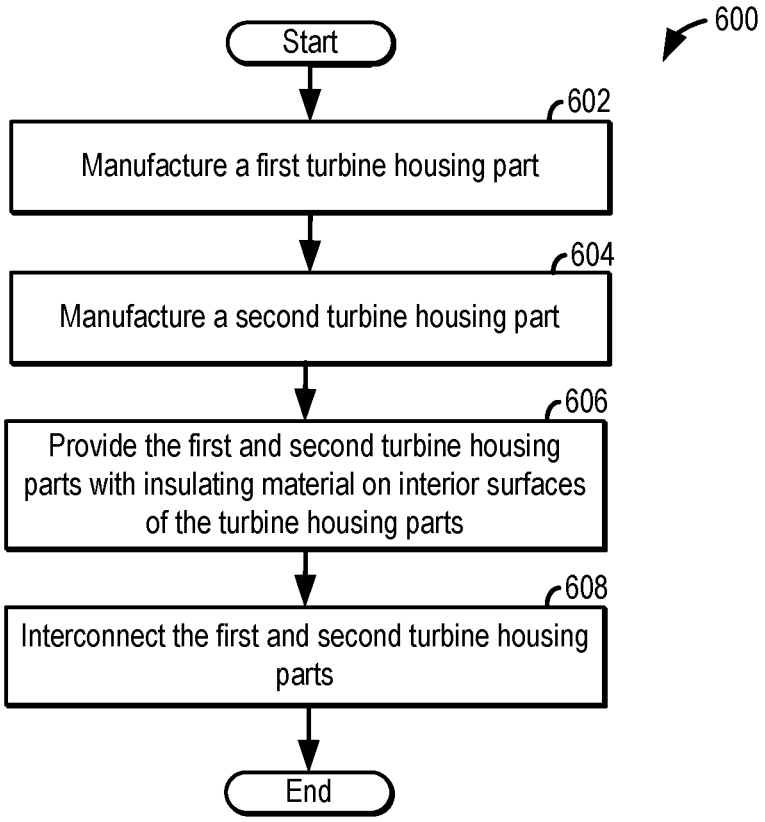
FIG. 6 shows a method for manufacturing a turbine housing.

FIG. 6 shows a method 600 for manufacturing a turbine housing. The method 600 may be used to manufacture the turbine housing described above with regard to FIGS. 1-5 or may be used to manufacture another suitable turbine housing, in other instances.

At 602 the method includes manufacturing a first turbine housing part. In one example, manufacturing the first turbine housing part may including casting the first turbine housing part. Additionally or alternatively, manufacturing the first turbine housing part may include machining the first turbine housing part.

At 604 the method includes manufacturing a second turbine housing part. Similar to the first turbine housing part, the second turbine housing part may be manufactured by casting and/or machining the part, in some examples. In other examples, different techniques may be used to manufacture the first and second turbine housing parts. For instance, one part may be cast while the other may be machined or vice versa.

At 606 the method includes providing the first and second turbine housing parts with insulating material on interior surfaces of the turbine housing parts. For instance, an interior surface of each of the first and second turbine housing parts may be coated with an insulating material.

At 610 the method includes interconnecting the first and second turbine housing parts. Interconnecting the turbine housing parts may include welding the first and second housing parts. Additionally or alternatively, interconnecting the turbine housing parts may include attaching the first and second turbine housing parts with fastening devices. The method 600 enables efficient manufacturing of a turbine housing with improved insulation. As a result, the thermal properties of the turbine are improved while reducing the turbine housing's manufacturing cost.

The present invention, for illustration purposes, has been explained based on a number of exemplary embodiments. A person skilled in the art, however, recognizes that deviations from the individual exemplary embodiments are possible and that features of individual exemplary embodiments can be combined with each other. Therefore, the turbine housing 2 can, for example, be divided into more than two housing parts 2*a*, 2*b* in order to then connect these in a positively locking, frictionally locking or materially bonding manner, as a result of which the accessibility of exhaust gas flow path regions which are to be provided with an insulation can be further improved.

The described exemplary embodiments refer to a turbine housing 2 for a turbocharger. However, the features of the present invention can also be used for other turbines. Furthermore, the intersecting surfaces can intersect the exhaust gas flow path 110 at an optional angle. In the case of a higher number of housing parts 2*a*, 2*b*, a plurality of intersecting surfaces and different angles are also possible. The invention is therefore not intended to be limited exclusively to the described exemplary embodiments but only by the attached claims.

The subject matter of the present disclosure is further described in the following paragraphs. According to one aspect, a method for producing a turbine housing made from cast metal is provided. The method includes during the production of the turbine housing, providing a first and second turbine housing parts with insulating material on a section of a wall which is adjacent to exhaust gas flow and located in the exhaust gas flow path region of the respective housing part and interconnecting the first and second turbine housing parts.

In another aspect, an exhaust gas turbine is provided. The exhaust gas turbine includes a first turbine housing part having insulating material extending along an interior surface and a second turbine housing part having insulating material extending along an interior surface, the second turbine housing part coupled to the first turbine housing part to form a volute directing exhaust gas to a turbine wheel.

In any of the aspects described herein or combinations of the aspects, the housing parts may be interconnected in a positively locking, frictionally locking or materially bonding manner.

In any of the aspects described herein or combinations of the aspects, the first and second housing parts may be coupled along a surface which is parallel to a flow direction of exhaust gas in the volute.

In any of the aspects described herein or combinations of the aspects, the first and second housing parts are coupled along a surface which is perpendicular to a flow direction of exhaust gas in the volute.

In any of the aspects described herein or combinations of the aspects, the insulating material in the first and second turbine housing parts may extend along the interior surface from an inlet to a turbine wheel housing.

In any of the aspects described herein or combinations of the aspects, the insulating material in each of the first and second turbine housing parts may extend along the interior surface from a flow inlet duct to a flow outlet duct.

In any of the aspects described herein or combinations of the aspects, the insulating material in each of the first and second turbine housing parts may be an insulating coating.

In any of the aspects described herein or combinations of the aspects, the first and second turbine housing parts may be constructed out of aluminum.

In any of the aspects described herein or combinations of the aspects, the first and second turbine housing part may be coupled by a weld.

FIGS. 1-5 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will further be appreciated by those skilled in the art that although the invention has been described by way of example with reference to several embodiments it is not limited to the disclosed embodiments and that alternative embodiments could be constructed without departing from the scope of the invention as defined in the appended claims.

Note that the example manufacturing method included herein can be used with various engine and/or vehicle system configurations. As such, various acts, operations, or functions illustrated may be performed in the sequence illustrated, in parallel, or in some cases omitted. Likewise, the order of the method steps may not necessarily required to achieve the features and advantages of the example embodiments described herein, but is provided for ease of illustration and description. One or more of the illustrated acts or functions may be repeatedly performed depending on the particular method being used.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. Further, one or more of the various system configurations may be used in combination with one or more of the described methods. The subject matter of the present disclosure includes all novel and non-obvious combinations and sub-combinations of the various systems and configurations, and other features, functions, and/or properties disclosed herein.

The invention claimed is:

1. A metal turbine housing for a turbocharger, provided with an insulating material for protection against high temperatures of an exhaust gas flow, comprising:

a flow inlet duct;

a turbine wheel housing which encloses a turbine wheel and is connected to the flow inlet duct; and a flow outlet duct which is connected to the flow inlet duct;

wherein an exhaust gas flow path extends through the flow inlet duct, through the turbine wheel housing, and through the flow outlet duct and the exhaust gas flow path has a wall which is adjacent to the exhaust gas flow path;

wherein the turbine housing comprises two interconnected housing parts in which is formed in each case a region of the exhaust gas flow path, wherein each exhaust gas flow path region includes a section of the wall which is adjacent to the exhaust gas flow path and the insulating material is provided along the exhaust gas flow path on an exhaust gas flow-facing side of the wall which is adjacent to the exhaust gas flow;

wherein the two interconnected housing parts include a first housing part and a second housing part that are interconnected via frictional locking using a plurality of fastening devices;

wherein the turbine housing is constructed out of aluminum; and wherein the two interconnected housing parts are interconnected along a connecting surface at the flow inlet duct, wherein a plane of the connecting surface at the flow inlet duct is perpendicular to a flow direction of the exhaust gas flow at the connecting surface.

2. The turbine housing as claimed in claim 1, wherein the turbine wheel housing encloses the turbine wheel in a spiral profile.

3. The turbine housing as claimed in claim 1, wherein the exhaust gas flow path has at least one branch.

4. The turbine housing as claimed in claim 3, wherein the exhaust gas flow path has a branch in the flow inlet duct and a branch in the flow outlet duct, and the branch in the flow inlet duct is fluidly interconnected with the branch in the flow outlet duct, bypassing the turbine wheel housing.

5. The turbine housing as claimed in claim 1, wherein the two interconnected housing parts are interconnected in a positively locking manner.

6. The turbine housing of claim 1, wherein the insulating material extends along an entirety of the exhaust gas flow path on the exhaust gas flow-facing side of the wall.

7. The turbine housing of claim 1, wherein a direction of the exhaust gas flow path at the flow outlet duct is angled relative to a direction of the exhaust gas flow path at the turbine wheel housing.

8. The turbine housing of claim 1, wherein an opening of the flow outlet duct is offset and opens at a different angle than an opening of the turbine wheel housing.

9. The turbine housing of claim 1, wherein the connecting surface circumferentially surrounds the exhaust gas flow, and wherein the plane of the connecting surface is further perpendicular to a length of the flow inlet duct.

10. A method for producing a metal turbine housing comprising:

during production of the turbine housing, providing a first turbine housing part and a second turbine housing part with insulating material on a section of a wall which is adjacent to exhaust gas flow and located in an exhaust gas flow path region of the respective housing part; and interconnecting the first turbine housing part and the second turbine housing part via frictional locking along a connecting surface at a flow inlet duct, wherein a plane of the connecting surface is perpendicular to a flow direction of the exhaust gas flow at the connecting surface, wherein the connecting surface is further perpendicular to a length of the flow inlet duct, and wherein the frictional locking is performed using a plurality of fastening devices;

wherein the turbine housing is constructed out of aluminum.

11. The method as claimed in claim 10, wherein the first and second housing parts are interconnected in a positively locking manner.

12. The method of claim 10, wherein the connecting surface surrounds the exhaust gas flow.

13. An exhaust gas turbine comprising:

a first turbine housing part having insulating material extending along an interior surface; and a second turbine housing part having insulating material extending along an interior surface, where the second turbine housing part is coupled to the first turbine housing part to form a volute directing an exhaust gas flow to a turbine wheel;

where the first turbine housing part and the second turbine housing part are coupled along a connecting surface at a flow inlet duct, wherein a plane of the connecting surface at the flow inlet duct is perpendicular to a flow direction of the exhaust gas flow at the connecting surface, wherein the plane of the connecting surface is further perpendicular to a length of the flow inlet duct, and wherein the connecting surface surrounds the exhaust gas flow at the flow inlet duct;

where the first turbine housing part and the second turbine housing part are coupled via friction locking using a plurality of fastening devices; and where the first and second turbine housing parts are constructed out of aluminum.

14. The exhaust gas turbine of claim 13, where the insulating material in the first and second turbine housing parts extends along the interior surface from an opening of the flow inlet duct to a turbine wheel housing.

15. The exhaust gas turbine of claim 13, where the insulating material in each of the first and second turbine housing parts extends along the interior surface from the flow inlet duct to a flow outlet duct.

16. The exhaust gas turbine of claim 13, where the insulating material in each of the first and second turbine housing parts is an insulating coating.

17. The exhaust gas turbine of claim 13, where the first and second turbine housing parts are coupled by a weld.

18. The exhaust gas turbine of claim 13, where the connecting surface is only at the flow inlet duct.

* * * * *